United States Patent [19]

Spirk, Jr. et al.

[11] Patent Number: 4,511,341

[45] Date of Patent: Apr. 16, 1985

[54] ANIMATED COIN SORTING BANK

[76] Inventors: John W. Spirk, Jr., 50 Stonewood Dr.; John R. Nottingham, 60 Stonewood Dr., both of Moreland Hills, Ohio 44022

[21] Appl. No.: 593,475

[22] Filed: Mar. 26, 1984

[51] Int. Cl.[3] ..... A45C 1/12

[52] U.S. Cl. ..... 446/9; 133/3 D; 272/8 D; 40/421; 40/427

[58] Field of Search ..... 446/8, 9, 10, 11; 133/3 R, 3 C, 3 D; 272/8 R, 8 D; 232/5, 4 R; 40/435, 421, 427, 446, 133

[56] References Cited

U.S. PATENT DOCUMENTS

| | | | |
|---|---|---|---|
| D. 270,868 | 10/1983 | Spirk, Jr. et al. | D99/35 |
| 508,019 | 11/1893 | Hunter | 446/9 |
| 2,420,246 | 5/1947 | Keller | 232/5 |
| 2,513,100 | 6/1950 | Muri | 40/435 |
| 2,804,719 | 9/1957 | Glass | 446/9 |
| 3,313,477 | 4/1967 | Brown | 446/8 X |
| 3,367,346 | 2/1968 | Gdanski | 133/3 |
| 3,997,045 | 12/1976 | Yeung | 446/10 X |

*Primary Examiner*—Mickey Yu

*Attorney, Agent, or Firm*—Maky, Renner, Otto & Boisselle

[57] ABSTRACT

An animated coin sorting bank that provides a unique form of animation when a coin is deposited therein, and which sorts coins of different diameters. A coin deposited in the bank moves under gravitational/inertial forces from an inlet to a sorting area. As it moves between the inlet and the sorting area, the coin moves through an arcuate segment in which it engages and rotates a display member. Preferably, a composite image is formed partly on the display member and partly on a front cover, so that when the display member is rotated an element of animation of that composite image is produced. After releasing from the display disc the coin continues to move under gravitational/inertial forces to a sorting area in which the coin is sorted according to its diameter. According to the preferred embodiment a high speed rotation of the display member and a high speed sort is effected, in order to enhance the visual animation produced.

26 Claims, 33 Drawing Figures

FIG. 13
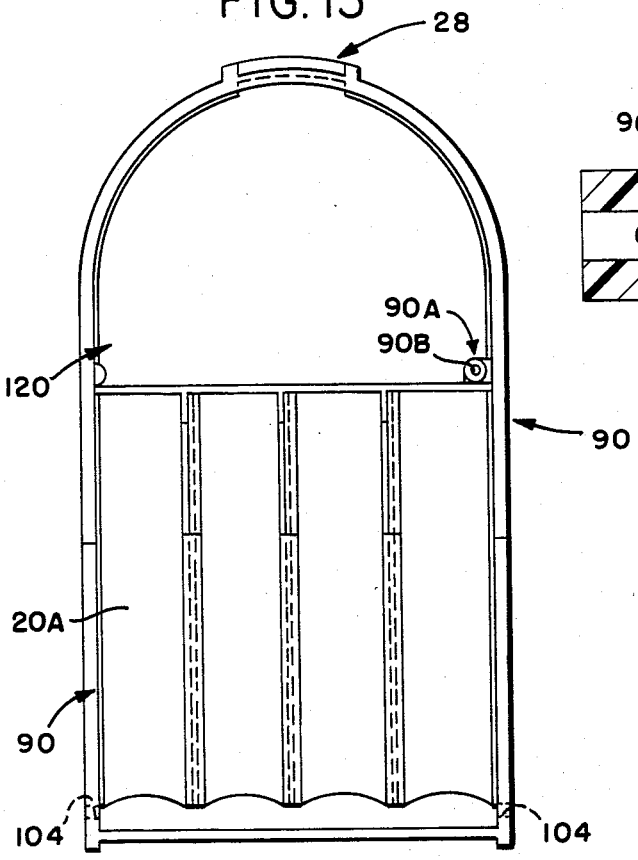
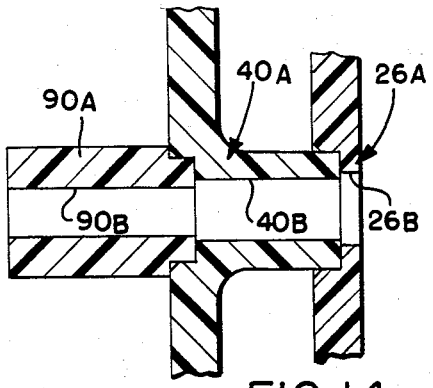
FIG. 14
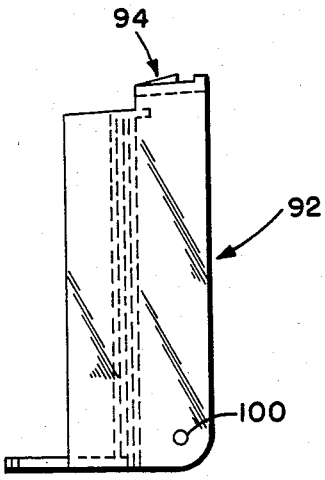
FIG. 16
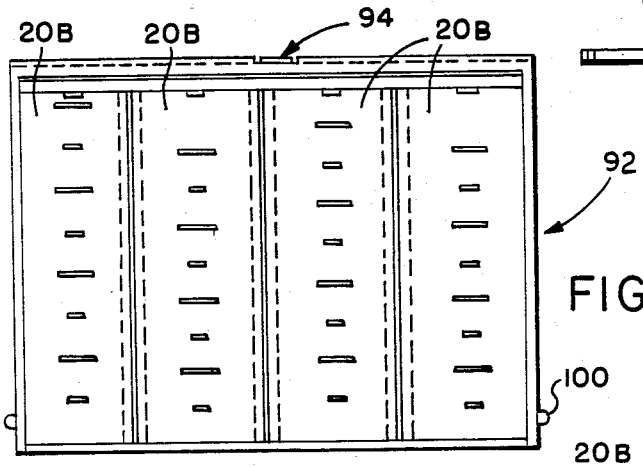
FIG. 15
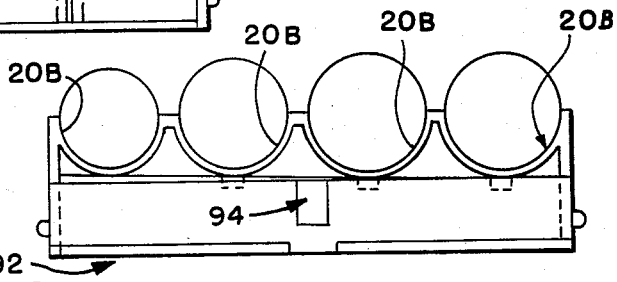
FIG. 17

ANIMATED COIN SORTING BANK

The present invention relates to a coin sorting bank and more particularly to a coin sorting bank which provides an animated display as different size coins are being sorted therein.

BACKGROUND

Numerous types of toy banks have been developed to entertain and fascinate both children and adults when a coin is deposited into the bank. Such banks have included levers, wheels, toggles, ramps, etc., that are engaged by the coin falling through the bank to generate an element of animation to provide enjoyment, entertainment, etc. In this application, such banks may be referred to as "animated banks". Some examples of animated banks are shown in U.S. Pat. Nos. Des. 270,868; 508,019; 2,804,719; and 3,313,477.

Some animated banks have been designed to provide the further feature of sorting different size coins into respective bins in the bank. Thus, the smallest diameter coins (e.g. a dime in U.S. currency) would be sorted in one bin, and larger diameter coins would be sorted in respective other bins. Some different types of banks that have been designed to provide both sorting and some kind of animation are shown in U.S. Pat. Nos. Des. 270,868 and 3,313,477. In the bank of U.S. Pat. No. Des. 270,868 sorting is effected by a combination of rotatable wheels, pivotal ramps, and static ramps. In U.S. Pat. No. 3,313,477, sorting is effected by static ramps that move the coin along a zig-zag, inclined path, and a series of different size openings in a wall disposed along one of the ramps. In each of the foregoing banks, the front wall of the bank is transparent, to allow the movement of the coin to be observed, thereby providing animation as the coin moves along the ramps and/or engages the various elements.

In the applicant's experience, banks that produce both animation and coin sorting can present complex design problems that must be addressed in order to properly effect both animation and sorting. One problem is the need to control the manner in which elements move to produce the desired form of animation. That problem is particularly acute where, as in the present invention, a rotatable display member and a display wall each have respective parts of a composite image, and the animation depends on the speed of rotation of the display member relative to the display wall. Another problem is the need to properly control the movement and the speed of coins during the sorting operation, so that the coins are properly sorted in their respective bin. Still other considerations that need to be addressed are how to achieve both animation and sorting in a relatively compact package, and how to provide unique enough animation to fascinate the user.

SUMMARY OF THE INVENTION

The present invention provides a compact, animated coin sorting bank which produces a unique form of animation and effectively sorts different size coins. The present invention produces animation by rotation of a display member, having part of a composite image, relative to a display wall having the other part of the composite image. In a bank according to the invention a coin moving toward a sorting area, under gravitational/inertial forces, applies a force-couple to the display member to rotate the display member, at a controlled rate, relative to the display wall. The speed and the direction of movement of a coin is controlled so that effective animation and also proper coin sorting is achieved. The concepts of the present invention can be used to design an animated sorting bank for coins of virtually any particular currency.

A basic aspect of the invention relates to the manner in which a coin moves under gravitational/inertial forces between an inlet and a sorting area. The display member is disposed between the inlet and the sorting area, and the sorting area includes a plurality of coin bins and a sorting ramp. Each of the coin bins is dimensioned to receive a different diameter coin, and the sorting ramp is designed to receive coins of different diameters and to sort the coins in respective coin bins according to their diameters. A coin moves from the inlet to the sorting area in an upright orientation under gravitational/inertial forces, and as it moves towards the sorting area it engages an actuating surface connected with the display member and imparts rotation to the display member. After imparting rotation to the display member, the coin is released from the display member, and the coin is directed, under gravitational/inertial forces, to the sorting area. The speed and direction of movement of the coin between the inlet, the display member, and the sorting area, is controlled so as to achieve effective sorting of the coin in its respective bin. Also, the movement of the coin is controlled so as to impart a sufficient rate of rotation of the display member to effect the desired animation.

The display member is preferably a disc supported for rotation about a central axis. The path of travel of a coin between the inlet and the sorting area includes an arcuate segment that at least partially circumscribes the central axis of rotation of the disc. The disc includes a plurality of circumferentially spaced actuating surfaces, each of which can be engaged by a coin as the coin moves in an upright orientation along the arcuate segment of its path of travel. The actuating surfaces are disposed so that when a coin moves along the arcuate segment of its path of travel and engages an actuating surface, a force couple is applied to the disc that rotates the disc about its central axis. After imparting rotation to the disc, the coin is released from engagement with the actuating surface on the disc and the coin is directed under gravitational/inertial forces to the sorting area where it is sorted according to its diameter.

Also, according to the preferred form of the invention, the display wall comprises a front cover disposed in front of the disc and animation is provided through a moire effect between graphic material contained on a surface of the disc and additional graphic material on the front cover. To produce the moire effect, the disc has to achieve a certain rate of rotation, but not too great a speed of rotation. The movement of the coin from the inlet and through its arcuate segment helps control the force-couple applied by the coin to the disc, thereby helping to control the rate of rotation of the disc. Additionally, the actuating surfaces on the disc are so spaced to ensure that a coin will engage an actuating surface during the initial phase of its arcuate segment. The coin slowly begins rotating the disc, and then significantly increases the speed of the disc as the coin moves through the later phase of its arcuate segment.

Still further, according to the preferred embodiment, the disc is rotated at a high enough speed, even by the smallest mass coin, to produce the desired form of animation. Specifically, the actuating surfaces on the disc are disposed so that when engaged by even the smallest mass coin, a relatively high rate of rotation is imparted to the disc. As the disc rotates at that high rate, a coin is hurled radially outward from the disc under centrifugal forces, and the housing guides the coin under gravitational/inertial (including centrifugal) forces to the sorting area. Specifically, the housing has an arcuate surface against which the coins are thrown, and a guide surface which engages the inner periphery of the smallest diameter coin, as that coin is thrown outwardly against the arcuate surface. Together, the arcuate surface and the guide surface guide the smallest diameter coin directly to its respective coin bin. The larger diameter coins are also thrown against the arcuate surface, and are guided by the arcuate surface along an arcuate trajectory and onto the sorting ramp at a relatively high rate of speed. The arcuate trajectory of the larger diameter coins is such that as they move onto the sorting ramp they can be effectively sorted according to their respective diameters. The preferred embodiment achieves a high speed sort utilizing a single sorting ramp for the larger diameter coins.

In another embodiment, a special slot is provided above the sorting ramp for receiving the smallest diameter coin. Rather than allowing centrifugal force to actually throw that smallest diameter coin outward from the disc, the outside peripheral edge of that coin is trapped, or confined, and the coin is guided along a path to bring it to the special slot before the coin can reach the sorting ramp. The larger diameter coins essentially free-fall onto the sorting ramp, and then roll down the sorting ramp to their respective sorting slots.

The further objects and advantages of the invention will become further apparent from the following detailed description taken with reference to the annexed drawings.

DETAILED DESCRIPTION OF THE DRAWINGS

In the annexed drawings:

FIG. 13 is a front plan view of the housing part of FIG. 11;

FIG. 14 is a fragmentary illustration, taken on an enlarged scale, of the manner in which components of the housing part, the front cover and the back wall interfit;

FIG. 15 is a front elevational view of a pivotal member that defines part of the coin bins;

FIG. 16 is a side view of the pivotal member of FIG. 15;

FIG. 17 is a bottom view of the pivotal member of FIG. 15;

DETAILED DESCRIPTION OF THE PREFERRED EMBODIMENT

As discussed above, the present invention provides an animated coin sorting bank which produces a unique form of animation and effectively sorts different size coins. The present invention produces animation by rotation of a display member, preferably a disc, having part of a composite image, relative to a display wall having the other part of the composite image. In a bank according to the invention a coin moving toward a sorting area, under gravitational/inertial forces, applies a force couple to the disc to rotate the disc relative to the display wall. The speed and the direction of movement of a coin is controlled so that effective animation and also proper coin sorting is achieved. The concepts of the present invention can be used to design an animated sorting bank for coins of virtually any particular currency. The following description explains the manner in which the principles of the present invention are used to form a bank for a particular (e.g. U.S.) currency. However, from that description, the manner in which the principles of the invention can be used to form a bank for another currency will be clear to those of ordinary skill in the art.

Figure 1:
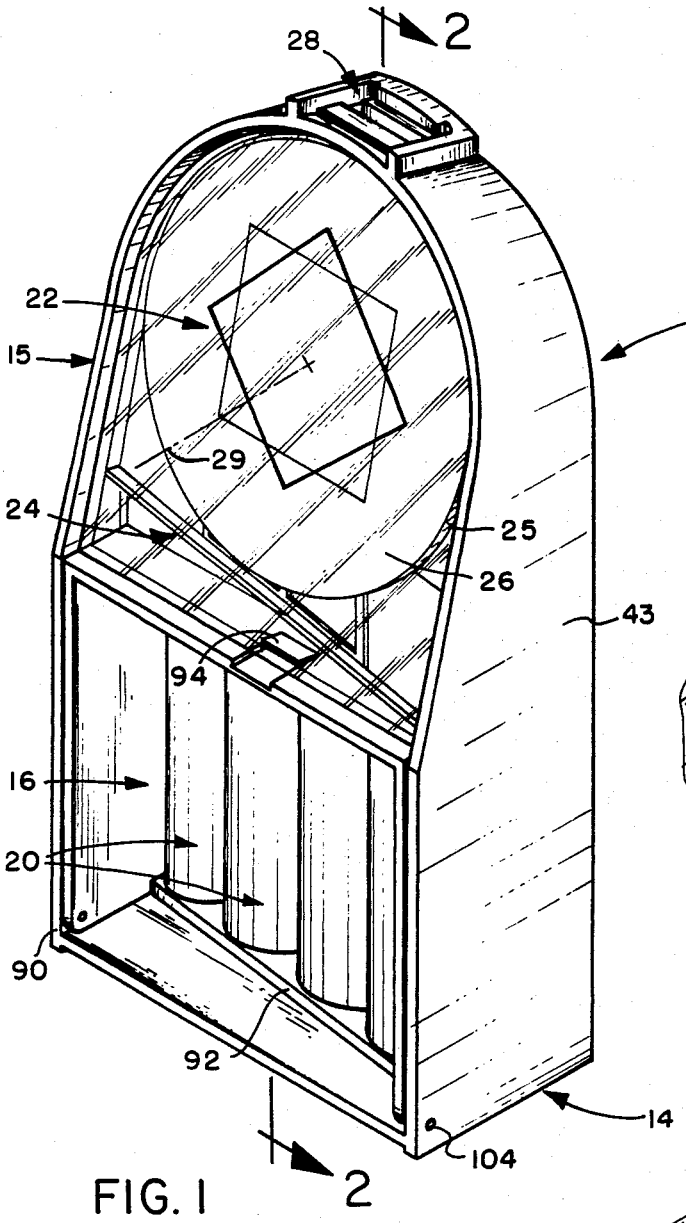
FIG. 1 is a perspective schematic illustration of an animated coin sorting bank according to the invention, showing a simplified form of animation.

FIG. 1 schematically illustrates the overall configuration of an animated sorting bank 10 according to the principles of the invention. A generally upright housing 12 has a base portion 14 which is designed to rest on a support surface, with the housing 12 extending generally upward and upright from the support surface. The housing 12 comprises an upper portion 15 and a lower portion 16. The lower portion 16 includes the base portion 14, and a plurality of bins 20, each for receiving a respective diameter coin. The upper portion 15 includes a display area 22 in which animation is provided, and a sorting ramp 24 which sorts coins according to their diameters and directs the coins to their respective bins.

In the display area 22, a rotatable disc 25 and a display wall 26 have respective portions of a composite image. In the preferred embodiment, the disc 25 is circular, and the display wall 26 comprises a front cover on the housing disposed in front of the disc 25. A coin dropped into an inlet 28 formed in the housing 12 engages an actuating means on the disc 25 and rotates the disc about its central axis 29. The disc 25 carries part of a composite image, and the front cover 26 of the housing carries another part of the composite image. As the disc 25 rotates relative to the front cover 26, animation is provided. While the disc 25 is preferably circular, it can also have other geometrical shapes. Also, while the display wall 26 is preferably the front cover on the housing, it is contemplated that other parts of the bank can constitute the display wall.

In the preferred embodiment, a moire effect is utilized to produce animation when the disc 25 rotates relative to the front cover 26. To produce the moire effect, the disc 25 has to rotate at a controlled rate relative to the front cover 26. The particular rate of rotation depends upon the rate needed to produce the moire effect desired. For a particular image, too fast or too slow a rate of rotation of the disc 25 will not produce the moire effect. Moreover, within the acceptable range of rotation, it is normally desirable to rotate the disc 25 in an optimum range, to attain the maximum quality of animation due to the moire effect. With the preferred embodiment, the disc 25 can be rotated in the optimum range even with the smallest mass coin (i.e. a dime in U.S. currency).

The upper portion 15 of the housing is, preferably, tilted slightly backward (at about 15° to the vertical). A coin is deposited into the inlet 28 of the housing 12 in an upright orientation (with its edge leading) and the coin will assume a slightly backward tilted, but still upright, orientation conforming to the backward tilt of the housing 12. In this application, reference to the coin moving while in an "upright orientation" is intended to mean that the coin is moving with its edge leading and with the major plane of the coin extending either vertically, or tilted slightly backward from the vertical. The reason the entire upper portion 15 of the housing is preferably tilted backward is because it is desirable to have the coin tilted out of the vertical while the coin is on the sorting ramp 24. By providing the entire upper portion 15 of the housing in a tilted back orientation, the compactness of the bank is enhanced. However, if compactness is not overly important, then the upper portion of the bank can be more vertical, and the coin can be tilted out of the vertical when it reaches the sorting ramp 24.

A coin deposited into the inlet 28 in an upright orientation will move from the inlet 28 to the sorting area 24 in an upright orientation, under gravitational/inertial forces. The coin initially drops vertically from the inlet 28, and then begins to move through an arcuate segment 32 (FIGS. 18, 19) in which it circumscribes the central axis 29 of the disc 25. As the coin moves in the arcuate segment 32, in an upright orientation, the coin engages an actuating surface on the disc 25 and applies a force-couple to the disc 25 to rotate the disc about its central axis 29. The coin rotates the disc 25 about its central axis 29 at a controlled rate to provide the desired form of animation.

Figure 2:
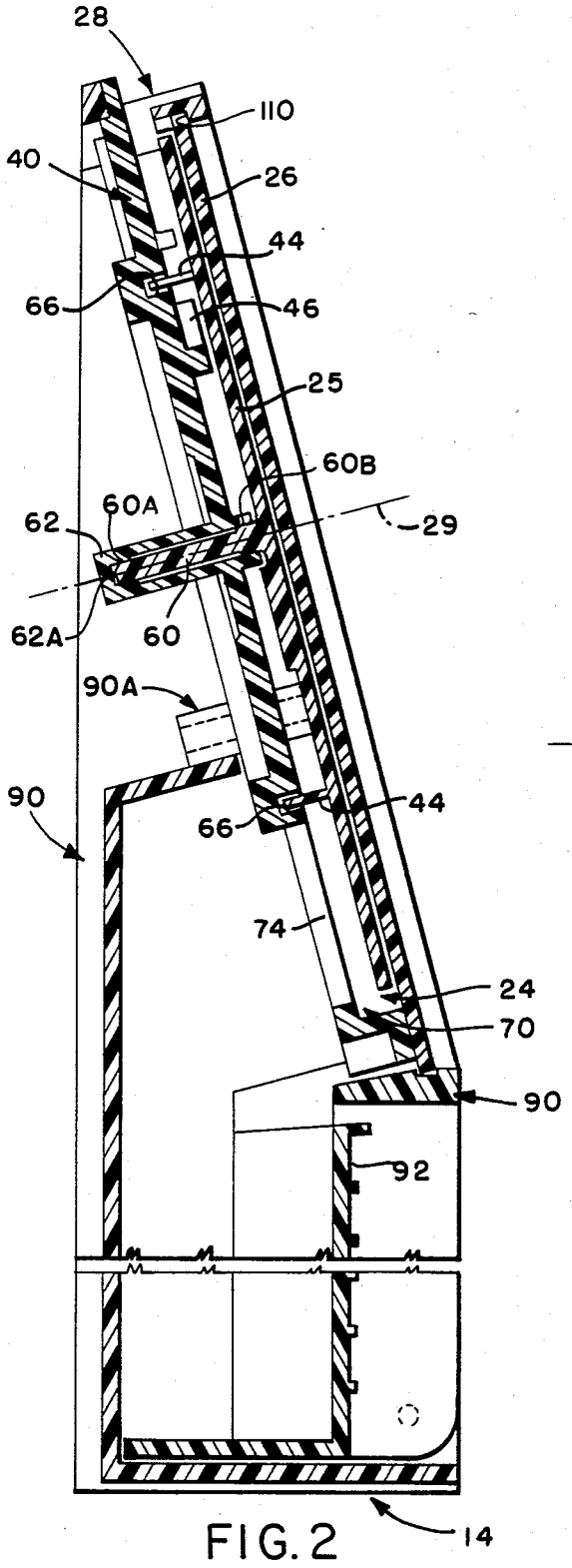
FIG. 2 is a sectional view of the bank of FIG. 1, taken from the direction 2—2 thereof.
Figure 6:
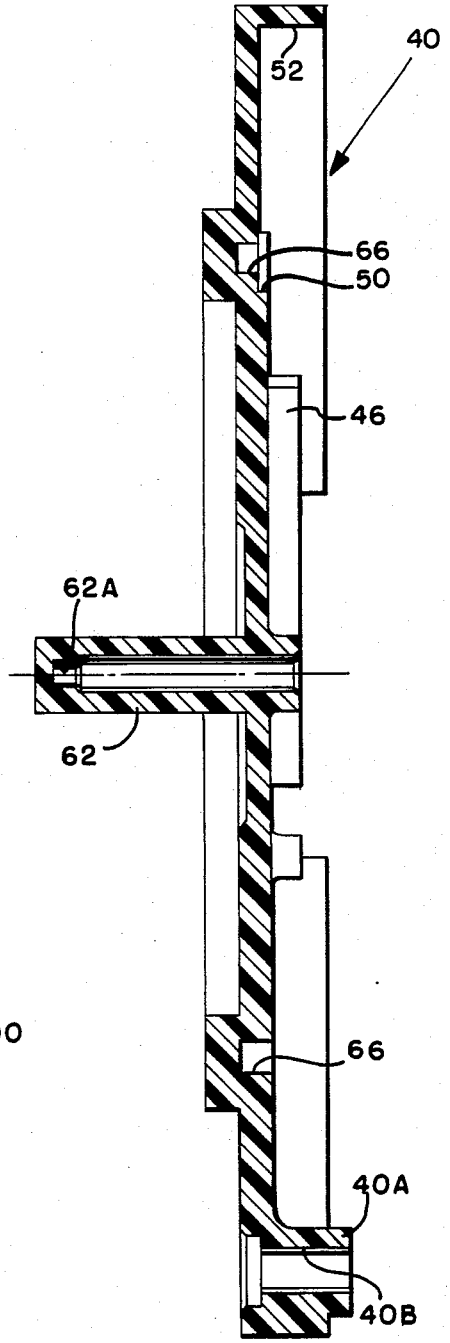
FIG. 6 is a sectional view of the back wall of FIG. 3, on an enlarged scale, taken from the direction 6—6.
Figure 5:
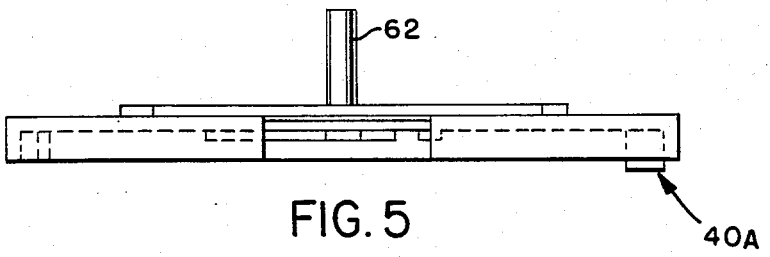
FIG. 5 is a top view of the back wall of FIG. 3, taken from the direction 5—5 thereof.

Referring to FIG. 2, three major components of the display section are a back wall 40, the front cover 26 which is spaced from the back wall, and the disc 25. Also, the housing 12 has an intermediate side wall 43 (FIG. 1) that extends transverse to the front cover and the back wall. The space between the front cover, the back wall and the intermediate side wall 43 is dimensioned to allow a coin to move therein in a generally upright orientation. The major plane of the disc 25 is disposed at least partially between the front cover 26 and the back wall 40. The disc 25 carries a plurality of circumferentially spaced actuating pins 44 so disposed that a coin moving along its arcuate segment 32 must engage the surface of one of the actuating pins 44, to impart movement to the disc 25.

According to the preferred embodiment, the circumferentially spaced pins 44 extend rearward from the major plane of the disc 25 (FIG. 2). The outer surface of each pin 44 comprises an actuating surface that can be engaged by a coin disposed between the front cover and the back wall in an upright orientation. The back wall 40 has a forwardly extending arcuate ramp 46 that is disposed radially inwardly of the pins 44. The arcuate ramp 46 defines the arcuate segment 32 of the path of travel of a coin.

Figure 3:
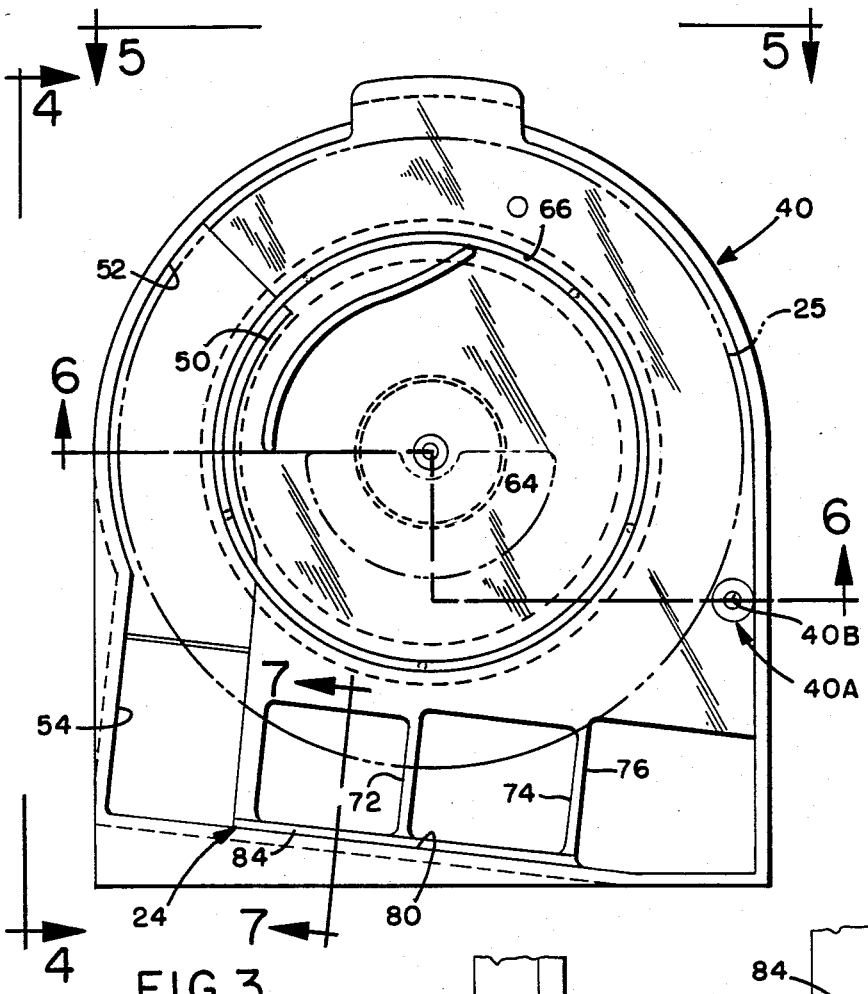
FIG. 3 is a plan view of the back wall of the bank of FIG. 2.

The profile of the back wall 40 is shown in FIGS. 3–6. In FIG. 3, the outline of the display disc 25 is shown in phantom, to illustrate the dimensional relationship of the display disc to the back wall. The back wall includes a specially designed guide surface 50 for engaging the inner peripheral edge of the smallest diameter coin (e.g. a dime in U.S. currency) during certain portions of its path of travel. Also, the back wall 40 has at least part of an arcuate surface 52 which, together with the guide surface 50, defines a guide path leading towards a special coin slot 54 disposed at the upper end of the sorting ramp 24 and dimensioned to receive the smallest diameter coin. When the smallest diameter coin is rotating the disc 25, the coin is thrown radially outward by centrifugal forces. Its outer edge is engaged by the arcuate surface 52 and its inner edge is trapped by the guide surface 50 in the back wall. The motion of the coin is thereafter confined by those surfaces, and the coin is guided toward its sorting slot 54.

The arcuate surface 52 on the back wall 40 also engages the outer edge of any of the larger diameter coins as they are thrown outward from the disc 25 by centrifugal forces. As a coin is thrown outward from the disc-display wheel, its outer edge engages the arcuate surface 52, and the coin traverses that segment of the bank under gravitational/inertial (including centrifugal) forces. The arcuate surface 52 is configured to guide the larger diameter coins across the smallest coin slot 54, along a trajectory that ensures that the larger diameter coins cannot be trapped by the coin slot 54. Additionally, the configuration of the arcuate surface 52 is such that when a larger diameter coin is directed onto the sorting ramp 24, the trajectory of the coin will cause it to immediately begin rolling down the sorting ramp. When the larger diameter coins are on the sorting ramp 24 the coins are sorted according to their respective diameters even though they are moving at a high rate of speed with high kinetic energy. This high speed sort function is useful because it allows the coins to move at high speeds, to enhance the overall visual effect provided, as well as helping make the bank compact, because only a single sorting ramp is needed.

The disc 25 includes a long shaft 60 (FIG. 2) which fits into a bore in a hub 62 formed in the back wall 40. The hub 62 has a reduced diameter bore 62A and the shaft 60 is dimensioned to have bearing contact with the hub 62 at the spaced apart points on the shaft labeled 60A, 60B in FIG. 2. The surfaces of the bearing points 60A, 60B on the shaft 60 are highly polished, to minimize friction at the bearing points. The disc 25 has a portion 64 that forms a counterweight to help bring the disc to a neutral or rest position after a coin has rotated the disc 25. Additionally, the spaced pins 44 that project backwardly from the disc can ride in a circular recess 66 formed in the back wall 40. The circumferential spaces between the pins 44 are dimensioned to receive a coin. Since the pins 44 are radially outward of the arcuate ramp 46, the combination of the pins 44 and the ramp 46 effectively define slots, each of which can receive a coin as the coin moves through its arcuate segment.

In the arcuate segment of its path of movement, a coin initially moves through a phase that is primarily horizontal, and then through a phase (trajectory) that is primarily vertical. Specifically, after falling vertically, the coin hits the arcuate ramp 46, and finds a position between an adjacent pair of pins 44. The coin will begin moving along the ramp 46, and will engage the pin 44 disposed in the direction the coin is moving. The coin will apply a force-couple to the disc 25 to impart rotation to the display disc 25. The spacing of the pins 44 is such that when the disc is in its neutral or rest position the coin will engage a pin 44 as the coin moves in the initial phase of its arcuate segment 32. By the time a coin reaches the vertical phase, the coin should be in full engagement with a pin 44 and imparting the highest amount of velocity to the disc 25.

As the coin imparts velocity to the disc 25, it can be thrown radially outwardly under centrifugal forces. The coin should begin to leave the disc partway through its vertical phase, under the centrifugal forces imparted to it. The pins 44 are disposed on a radius which enables them to help guide the coins in an outward direction, under the centrifugal forces imparted thereto. As a coin is thrown outwardly, its outer edge engages the arcuate surface 52, and the motion of the coin is controlled in the manner described above, so that the smallest diameter coin is guided to its special coin slot 54, and the larger diameter coins are thrown onto the sorting ramp provided in the sorting area.

Figure 7A:
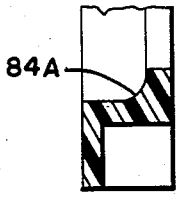
FIG. 7A is a sectional view, similar to FIG. 7, but showing the profile of an alternative type of sorting ramp.
Figure 7:
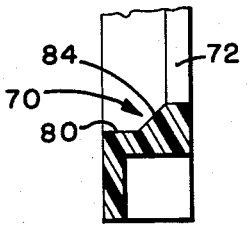
FIG. 7 is a sectional view of part of the profile of the sorting ramp in the back wall of FIG. 3, taken from the direction 7—7.
Figure 4:
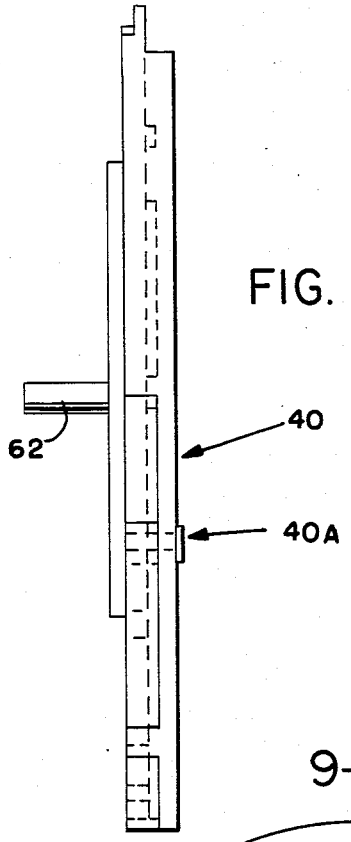
FIG. 4 is a side view of the back wall of FIG. 3, taken from the direction 4—4 thereof.
Figure 9:
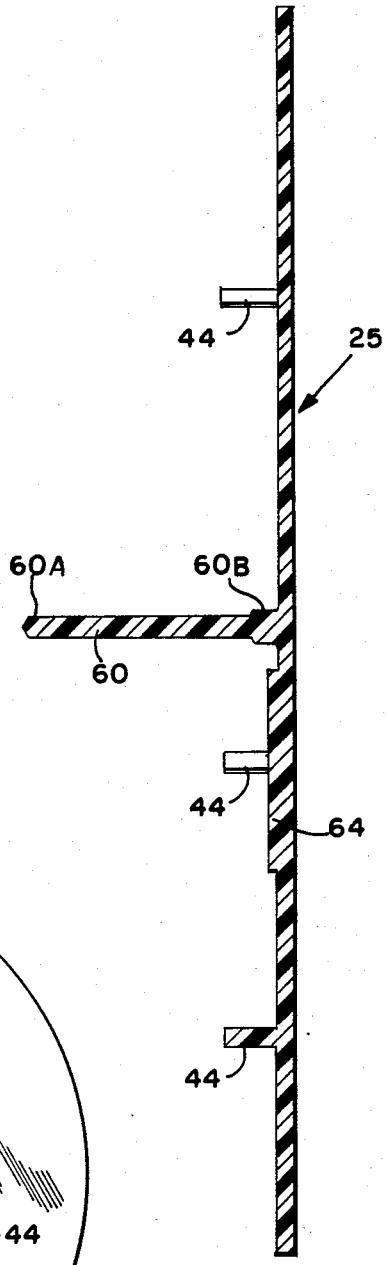
FIG. 9 is a sectional view of the display disc of FIG. 8, on an enlarged scale, taken from the direction 9—9.
Figure 8:
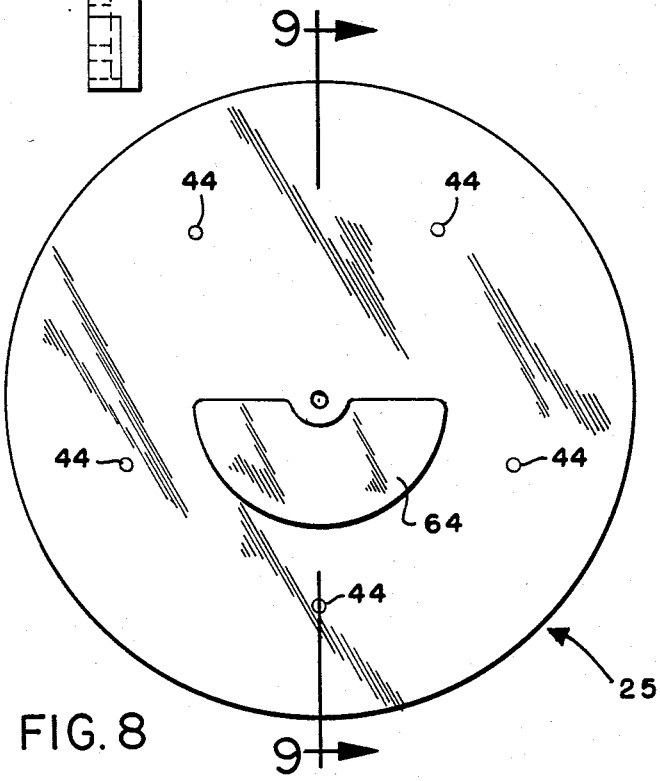
FIG. 8 is a front elevational view of a display disc for the bank of FIG. 2.

The sorting ramp 24 basically comprises two components. It comprises a part of the back wall 40 against which a face of a coin can ride, and a specially configured inclined surface 70 extending forwardly from the back wall 40, and against which an edge of a coin can engage. The portion of the back wall 40 that defines the sorting ramp is essentially flat and has a plurality of different dimensioned, generally rectangular slots, e.g. 72, 74, 76. The slots progressively increase in dimension to allow a different diameter coin to fall therethrough. For example, in a bank for U.S. currency the slot 72 is dimensioned to receive a penny, the slot 74 is dimensioned to receive a nickel and the slot 76 is dimensioned to receive a quarter. The inclined surface 70 has a geometry specially configured so that when the edge of a coin engages the surface 70, the coin is tilted further backward toward the back wall 40 to enable the coin to readily fall into an appropriate slot in the back wall 40. Thus, the geometry of the inclined surface 70 (FIG. 7) includes a surface 80 disposed below the slots 72, 74, 76, and an intermediate surface 84 extending upward toward the slots 72 and 74. The intermediate surface 84 is configured so that the corner of a coin thrown onto the sorting ramp 24 should hit the intermediate surface 84, and the coin should tilt backward toward the slots in the back wall 40. The specific configuration of the intermediate surface 84 may depend on the specific configuration of the coins the bank is designed for. For example, a straight intermediate surface 84, as depicted in FIG. 7, may be useful for certain types (e.g. U.S., Japanese) coins. The intermediate surface 84 may require a slightly different profile (e.g. the type of curved profile 84A shown in FIG. 7A) to accommodate coins of a different currency (e.g. British coins). The important fact is that the intermediate surface 84 be designed to engage the corner of a coin and to cause the coin to immediately tilt backward toward the back wall 40. With that configuration, the coins are in a position to be effectively sorted by the respective slots 72, 74, 76.

Figure 11:
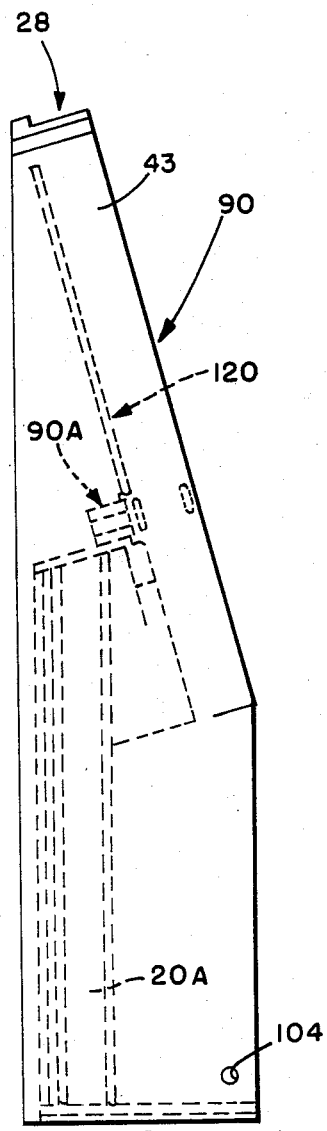
FIG. 11 is a side elevational view of the housing part for the bank of FIG. 2.
Figure 12:
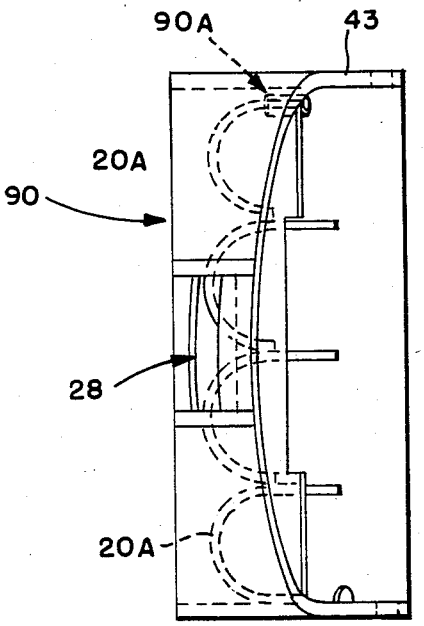
FIG. 12 is a top elevational view of the housing part of FIG. 11.

When a coin drops through a slot 54, 72, 74, 76 in the back wall 40, the coin falls into its respective coin bin 20 in the lower area of the bank. The coin bins 20 are preferably cylindrical, and are formed partially in a housing part 90, and partly in a pivotal member 92 (FIGS. 15–17) connected with the housing part 90. The housing part 90 (FIGS. 11–13) is a molded plastic member with parts 20A of the bins molded therein. The other parts 20B of the coin bins are formed in the pivotal member 92. The pivotal member 92 comprises a plastic member with a pair of pivot pins 100 at its lower end. The pivot pins 100 can engage respective holes 104 in the housing part 90 to provide a pivotal connection between the member 92 and the housing part 90. At its top end, the pivotal member 92 includes a resiliently deflectable latch 94 (FIG. 1). The latch 94 can have a locking engagement with the inside of the front wall 26. Downward pressure on the latch 94 releases the latch from engagement from the inside of the front wall 26 and allows the member 92 to be pivoted forwardly, thereby allowing coins to be removed when the bins are filled.

Figure 10:
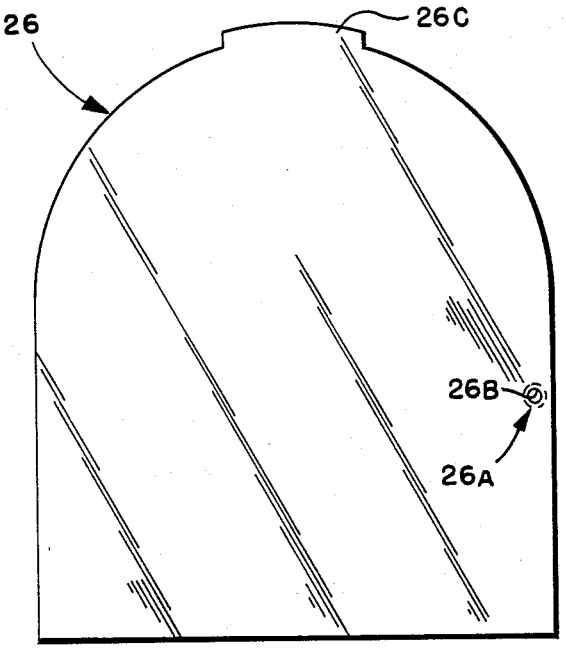
FIG. 10 is a front plan view of the front cover for the bank of FIG. 2.

The front cover 26 (FIG. 10) is a molded plastic member. It is essentially planar, and its profile is depicted in FIG. 10.

In assembling the various components, the disc 25 is assembled with the back wall 40, by inserting the long shaft 60 of the disc into the integral hub 62 formed in the back wall 40. The housing part 90 has an upper portion 120 dimensioned to receive and support the back wall 40. The front cover 26 is placed over the disc, and the housing part 90, the front wall 26, and the back wall 40 have respective portions 90A, 26A and 40A (with aligned openings 90B, 26B, 40B) that interfit in the manner depicted in FIG. 14. A locking screw (not shown) is inserted in the aligned openings in the portions 90A, 26A and 40A, and secures these members together. The front cover 26 has a top portion 26C that inserts behind a ledge 110 on the housing part 90, to help maintain those members in proper alignment. With the members thus assembled, the disc 25 can rotate in the space between the front cover 26 and the back wall 40. The pins 44 carrying the actuating surfaces extend backward from the disc 25 and ride in the circular recess 66 formed in the back wall 40. The arcuate ramp 46 on the back wall 40 extends forwardly thereof, and the spacing of the parts is such that a coin inserted through the inlet 28 in the housing must engage the arcuate ramp 46, and will engage an actuating surface on a pin 44 during the arcuate segment of its path of movement.

Figure 18:
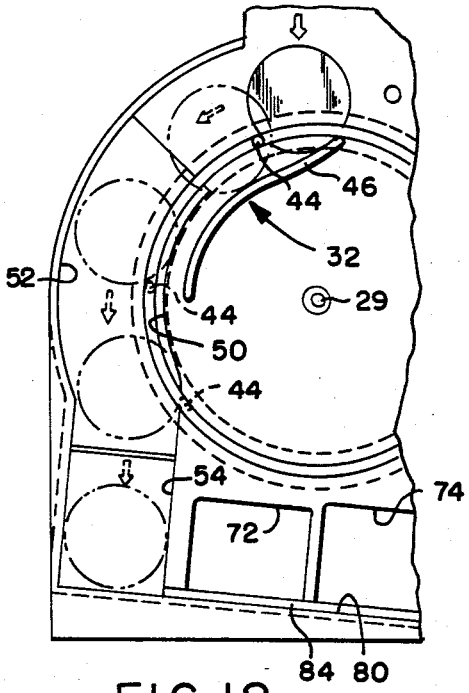
FIG. 18 is a schematic, fragmentary illustration of the manner in which the smallest diameter coin moves in a bank according to the invention.

The path of a smallest diameter coin in the display area is depicted schematically in FIG. 18. In FIG. 18, a pin 44 is shown, but the disc is omitted for the sake of clarity. The coin initially drops vertically until it encounters the arcuate ramp 46. As it encounters the arcuate ramp 46 it begins moving along the ramp and also finds a position against one of the pins 44 on the disc. The initial phase of movement of the coin is primarily horizontal. In that initial phase, the coin not only engages an actuating pin 44, but also begins to impart rotation to the disc. After imparting rotation to the disc, the coin begins its vertical phase. In that vertical phase, the gravitational/inertial forces on the coin (including centrifugal forces due to the motion of the disc) speed up the rotation of the disc dramatically. Even with the smallest diameter coin (e.g. a dime in U.S. currency) the rotation of the disc should be significant. As the disc speeds up, increased centrifugal forces are imparted to the coin, and when a coin is in its vertical phase, the coin is thrown radially outward by the centrifugal forces. The outer peripheral edge of the coin engages the arcuate surface 52 on the back wall and gravitational/inertial (including centrifugal) force the coin to continue to move downward. The guide wall 50 confines the smallest diameter coin at its inner peripheral edge so that, along with the arcuate surface 52, the smallest diameter coin is guided downwardly under gravitational/inertial (centrifugal) forces. As seen from FIG. 18, the smallest diameter coin is guided directly to its respective slot 54, which is at the upper end of the sorting ramp 24.

Figure 19:
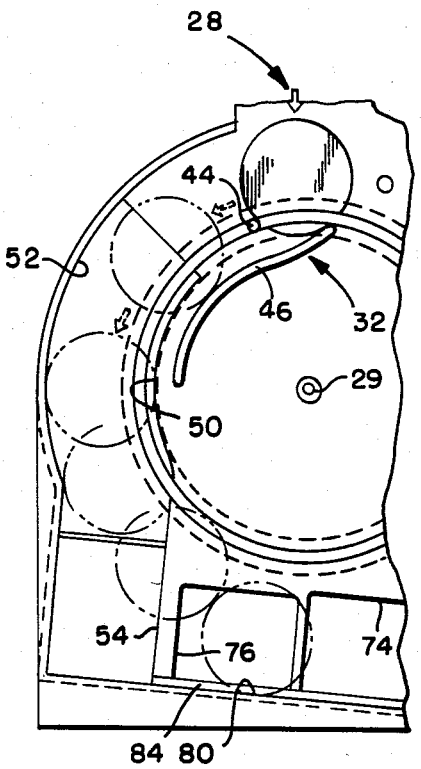
FIG. 19 is a schematic, fragmentary illustration of the manner in which a larger diameter coin moves in a bank according to the invention.

The motion of a larger diameter coin (e.g. a nickel in U.S. currency) is schematically depicted in FIG. 19. With a larger diameter coin the momentum imparted to the disc is a little higher, and the rate of rotation of the disc is a little higher. Also the centrifugal forces are higher. Such a larger diameter coin gets thrown outward in the same manner as the small diameter coin. The difference, however, is that its diameter is such that it is not trapped by the guide surface 50 on the back wall 40. The coin is guided downwardly toward the sorting ramp 24 essentially by the arcuate surface 52. The trajectory of the coin causes it to partially overlap the sorting slot 54 for the smallest diameter coin. That trajectory, as well as the relative speed of movement of the coin, ensures that the larger diameter coin should not be trapped against the special slot 54, which is at the top of the sorting ramp 24. Further, the trajectory of the larger diameter coin minimizes the risk of the coin bouncing, and promotes immediate rolling action of the coin along the sorting ramp 24. The coin is guided onto the sorting ramp and is immediately tipped backward as its corner engages the intermediate surface 84 on the sorting ramp. Thus, the coin is readily sorted by the associated sorting slot 72, 74, 76 contained in the back wall 40.

After a coin has been released from the disc 25, the disc 25 can return to a neutral position. Specifically, the counterweight 64 on the disc 25 returns the disc 25 to its neutral position. When the disc 25 is in its neutral position, an actuating pin 44 is disposed in a position such that it will be engaged by a succeeding coin deposited into the bank.

Figure 1A:
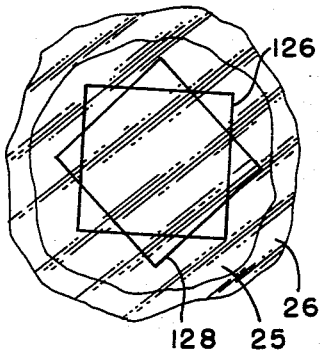
FIGS. 1A and 1B are fragmentary, schematic illustrations of the simplified animation provided by the bank of FIG. 1.
Figure 1B:
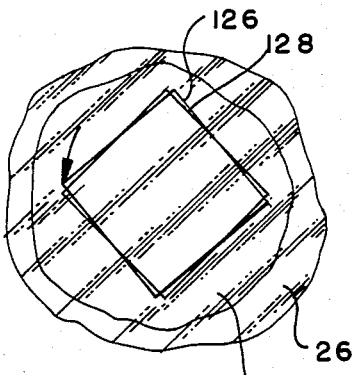

FIGS. 1A and 1B schematically illustrate a simplified form of animation. Specifically, the disc 25 carries a part 126 of an image, and the front cover 26 carries the other part 128 of the composite image. As the disc 25 rotates, the parts 126, 128 of the composite image change, as shown in FIG. 1B.

Figure 21:
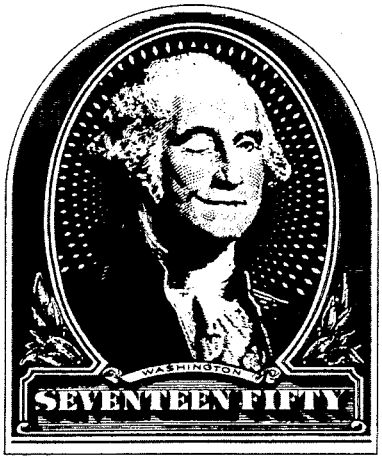
FIGS. 21–25 show the graphics for forming a composite image according to a preferred embodiment.
Figure 22:
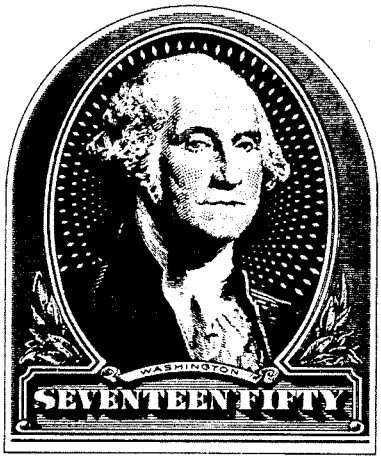
Figure 23:
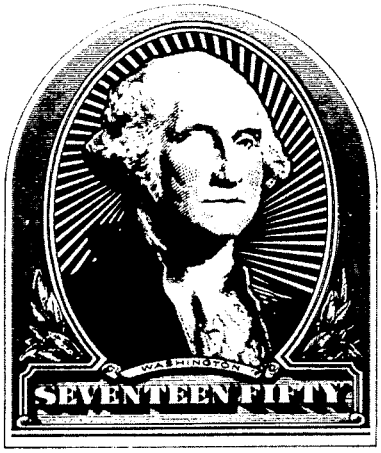
Figure 24:
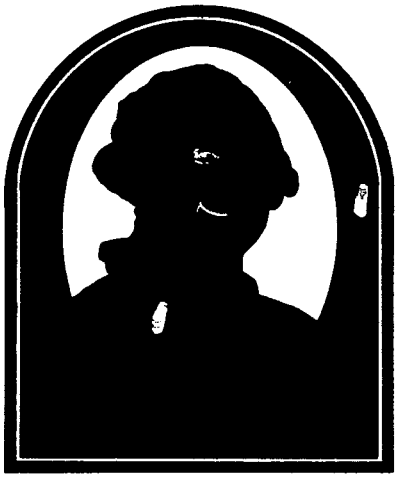
Figure 25:
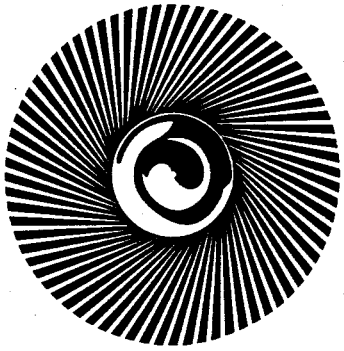

The manner in which animation is provided, according to the preferred embodiments, is in accordance with applicants' design application Ser. No. 509,412, which is incorporated herein by reference. The specifics of the animation are depicted in FIGS. 21–30. One form of animation (FIGS. 21–25) provides a figure which changes its facial expression (i.e. it winks and smiles) as the disc 25 is rotated. To create that animation, the graphics of FIG. 25 are provided on the disc 25, and a graphic image made from a composite of the negatives shown in FIGS. 23, 24 is provided on the front cover 26 essentially by a screening or printing operation, which is well known to those in the art. When the disc rotates, its graphics change the image from what is shown in FIG. 22, to what is shown in FIG. 21, to provide the animation. A moire effect is preferably utilized to enhance the animation.

Figure 26:
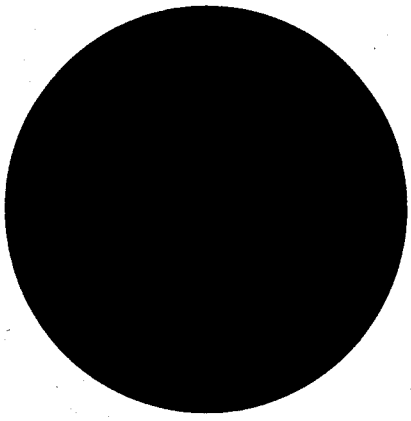
FIGS. 26–30 show the graphics for forming another composite image according to another preferred embodiment.
Figure 27:
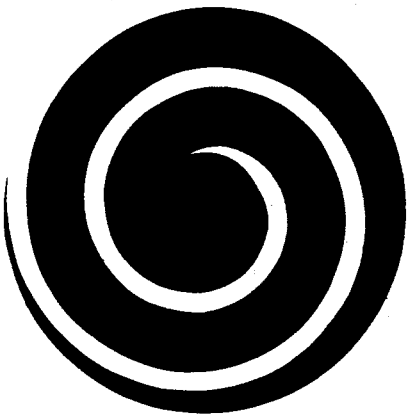
Figure 28:
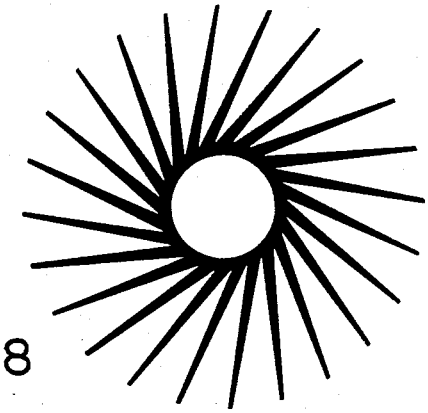
Figure 29:
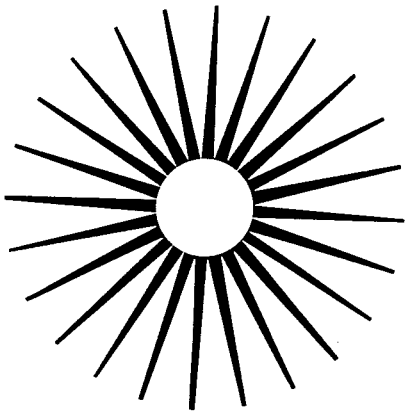
Figure 30:
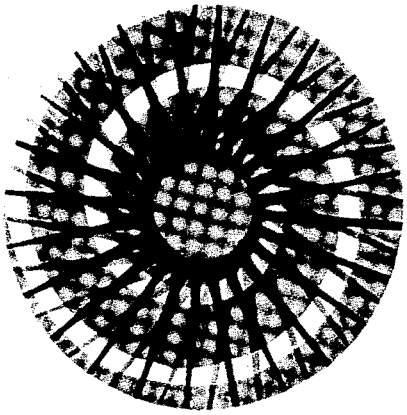

FIGS. 26–30 show the graphics for a different form of animation, according to another preferred embodiment. FIGS. 26–28 show graphics that are superimposed on each other and applied to the disc. FIG. 29 depicts graphics provided on the front cover 26. When the disc and the front cover are superimposed, the composite image looks as shown in FIG. 30. Rotation of the disc relative to the front cover provides animation by a moire effect between the graphics on those elements. In this application, the essence of the invention resides in the manner in which the display member (e.g. disc 25) is rotated to animate the composite image, and the manner in which coins are sorted. The specifics of the animation are preferably provided according to the applicants' design application. We have attached as Exhibit A copies of the Figures from our design application which illustrate the preferred form of graphics as also depicted in FIGS. 21–30. However, with this disclosure in mind, various different forms of animation using the principles of this invention will become apparent to those of ordinary skill in the art.

Figure 20:
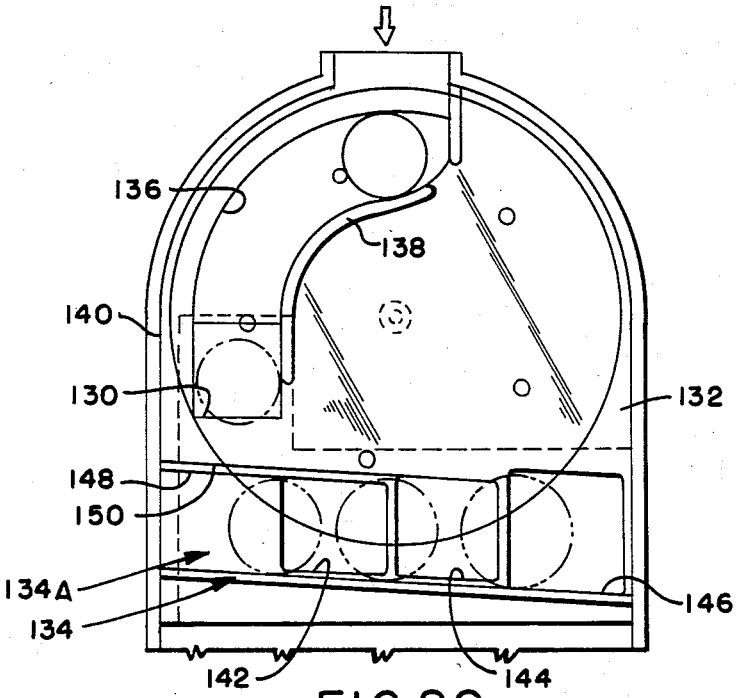
FIG. 20 is a schematic, fragmentary illustration of the display and sorting mechanism for a bank according to an alternate embodiment; showing the manner in which a smaller diameter coin is handled.

FIG. 20 schematically depicts an alternate form of bank made according to the broad principles of this invention. The bank includes a housing, display member (disc), sorting slots that are generally similar to those depicted in the preferred embodiment. The principal differences between the alternate embodiment and the present preferred embodiment is in the manner in which the smallest diameter coin (e.g. a dime in U.S. currency) is handled, and also in the specifics of the structure for sorting the various coins. In the alternate embodiment, there is a specially formed slot 130 formed in the back wall 132, for receiving the smallest diameter coin. That slot is disposed above the sorting ramp 134. There is also a specially designed guide wall 136 defined in the back wall 132. The guide wall 136 cooperates with the arcuate ramp 138 to guide the smallest diameter coin, by confining the movement of the smallest diameter coin throughout its travel along the arcuate segment. Thus, unlike the previous embodiment, the smallest diameter coin does not get thrown outwardly by centrifugal forces. Its movement is confined by the guide wall 136 and the arcuate ramp 138, to bring it into alignment with its sorting slot 130 in the back wall 132. With that alternate embodiment, the disc movement may not be as rapid as with the previous embodiment, although it will be sufficient to achieve a moire effect between material on the disc and material on the front cover. The remaining diameter coins essentially free-fall once they are released from engagement with the disc. They may be thrown outward slightly under centrifugal forces, but the outer surface 140 of the bank is essentially straight, so the coins free-fall toward the sorting ramp 134. We have attached as Exhibit B samples of the front cover, display wheel and back wall for banks according to the alternative embodiments, as made by our licensee, MAG-NIF.

Along the sorting ramp 134, there are sorting slots 142, 144, 146 in the back wall 136. There are also walls 148, 150 in the back wall to trap the upper edge of specific diameter coins and to guide those coins to specific sorting slots. The back wall 138 is backwardly inclined, and the coins have a natural tendency to tip backward and become sorted in their respective slots. With the alternate embodiment, the larger coins may bounce slightly as they hit the upper part 134A of the sorting ramp 134, but soon begin rolling at a controlled rate along the sorting ramp. As a coin encounters a respective slot, it tips backward into its respective slot.

As can be seen from the foregoing disclosure, the principles of this invention can be readily applied to construct an animated bank for sorting a particular currency. The specific dimensions of various elements may vary from currency to currency in order to accommodate the specifics of the type of coins sorted by the bank. For example, the radial location of the pins 44 may vary depending on the specific currency being sorted. Additionally, as discussed above, the geometry of the intermediate surface 84 on the sorting ramp may have to be varied to accommodate the specific dimensions of the coins being sorted. Still further, the specific dimension(s) of the slots (e.g. 54, 72, 74, 76) may have to vary somewhat to accommodate different size coins.

Preferably, the elements of the bank (other than the graphic material on the surface(s) of the disc and the front cover) are molded of plastic. The plastic is clear or at least transluscent, so that the movement of the coins is visible therein. In the display area, the movement of the coins provides an additional element of animation as the coins are being sorted. The transparency in the lower portion of the bank allows the person using the bank to see how full the coin bins are, so that it is easy to determine when the coins need to be removed.

It is believed that with the foregoing description in mind many and varied obvious modifications using the principles of this invention will become apparent to those of ordinary skill in the art.

We claim:

1. An animated sorting bank comprising a housing having an inlet for receiving a coin in an upright orientation, a display member supported for rotation about a central axis and a sorting area comprising a plurality of coin bins and a sorting ramp, said display member being rotatable relative to a display wall of said housing to cause animation of a composite image formed partly on said display member and partly on said display wall of said housing, each of said coin bins being dimensioned to receive a different diameter coin, said sorting ramp being designed to receive coins of different diameters and to sort the coins in respective coin bins according to their diameters, said housing and said display member cooperating to receive a coin from said inlet in an upright condition and to guide said coin by gravitational-/inertial forces between said inlet and said sorting area while maintaining the coin in the upright orientation, the path of travel of the coin between the inlet and the sorting area including an arcuate segment that at least partly circumscribes the central axis of the display member, the housing and the display member being further configured such that an initial phase of the movement of a coin along its arcuate segment is substantially horizontal and a succeeding phase of movement of the coin along its arcuate segment is substantially vertical, the display member including a plurality of actuating surfaces circumferentially spaced such that at any rotated angle of said display member at least one of said actuating surfaces will be positioned for engagement by a coin during its initial phase of movement and prior to its succeeding phase of movement along the arcuate segment of its path of travel, the actuating surfaces being further disposed so that when a coin moves along the arcuate segment of its path of travel and engages an actuating surface a force-couple is applied to the display member to rotate the display member about its central axis first slowly during its initial phase of movement and then significantly faster as the coin moves through the succeeding phase of movement along the arcuate segment, the housing and the display member being still further configured so that a coin is released from engagement from an actuating surface on the display member after imparting rotation to the display member, and the housing allowing a coin that is released from an actuating surface on the display member to move toward said sorting ramp under gravitational/inertial forces.

2. An animated sorting bank as defined in claim 1 wherein said housing includes a back wall and said display wall comprises a front cover spaced from said back wall, said display member being disposed at least partially between said front cover and said back wall, and said coin moving between said front cover and said back wall in an upright condition as it moves along said arcuate segment of its path of travel.

3. An animated coin sorting bank as defined in claim 2 wherein said housing is configured to allow a coin to fall initially through a vertical range when it is inserted into said inlet, and said housing and display member being configured to release a coin from engagement with said display member after said coin moves through said arcuate segment.

4. An animated sorting bank as set forth in claim 1 wherein the housing and the spaced actuating surfaces on the display member are so dimensioned that a coin inserted into said inlet falls initially through a vertical range under gravitational/inertial forces, the coin then moves along its arcuate segment while imparting rotation to the display member, and the coin thereafter drops onto the sorting ramp, the coin being maintained in a substantially upright orientation as it moves from the inlet to the sorting ramp.

5. An animated sorting bank as set forth in claim 1 wherein the display member comprises a disc having a plurality of circumferentially spaced pins protruding from a surface thereof, said actuating surfaces being defined by the outer surfaces of said pins.

6. An animated sorting bank as defined in claim 5 wherein said housing has an arcuate wall against which the edge of a coin is engaged as it moves through its arcuate segment.

7. An animated sorting bank as set forth in claim 6 wherein said pins are disposed on said display member so as to be radially outward of said arcuate wall.

8. An animated sorting bank as set forth in claim 7 wherein said back wall of said housing has an outer wall disposed radially outward of said arcuate wall for confining the outer periphery of a coin, said back wall also having another wall for confining the inner periphery of the smallest size coin.

9. An animated sorting bank comprising a housing having an inlet for receiving a coin in an upright orientation, a display member supported for rotation about a central axis substantially centered beneath said inlet, and a sorting area comprising a plurality of coin bins and a sorting ramp, said display member being rotatable relative to a display wall of said housing to cause animation of a composite image formed partly on said display member and partly on said display wall of said housing, each of said coin bins being dimensioned to receive a different diameter coin, said sorting ramp being designed to receive coins of different diameters and to sort the coins in respective coin bins according to their diameters, said housing and said display member cooperating to receive a coin from said inlet in an upright orientation and to direct the coin by gravitational/inertial forces between said inlet and said sorting area while maintaining the coin in the upright orientation, the path of travel of a coin between the inlet and the sorting area including an arcuate segment that circumscribes the central axis of the display member, means on the display member for engaging a coin in a way that allows the coin to impart angular momentum to the display member and to allow the display member to impart centrifugal forces to the coin as the coin moves along the arcuate segment of its path of travel initially substantially horizontally and then substantially vertically, the housing being dimensioned to allow a coin to be thrown outward from the display member by the centrifugal forces imparted thereto, and said housing having an arcuate surface concentric with the central axis of said display member for engaging and guiding the outer peripheral edge of a coin that is thrown outward by the centrifugal forces imparted thereto, said arcuate surface extending from an elevation above the central axis of said display member to an elevation below the central axis of said display member.

10. An animated sorting bank comprising a housing having an inlet for receiving a coin in an upright orientation, a display member supported for rotation about a central axis and a sorting area comprising a plurality of coin bins and a sorting ramp, said display member being rotatable relative to a display wall of said housing to cause animation of a composite image formed partly on said display member and partly on said display wall of said housing, each of said coin bins being dimensioned to receive a different diameter coin, said sorting ramp being designed to receive coins of different diameters and to sort the coins in respective coin bins according to their diameters, said housing and said display member cooperating to receive a coin from said inlet in an upright orientation and to direct the coin by gravitational/inertial forces between said inlet and said sorting area while maintaining the coin in the upright orientation, the path of travel of a coin between the inlet and the sorting area including an arcuate segment that circumscribes the central axis of the display member, means on the display member for engaging a coin in a way that allows the coin to impart angular momentum to the display member and to allow the display member to impart centrifugal forces to the coin as the coin moves along the arcuate segment of its path of travel, the housing being dimensioned to allow a coin to be thrown outward from the display member by the centrifugal forces imparted thereto, said housing having an arcuate surface for engaging and guiding the outer peripheral edge of a coin that is thrown outward by the centrifugal forces imparted thereto, and said housing also including a guide surface for engaging and guiding the inner peripheral edge of only the smallest diameter coin that can be sorted by said bank to the exclusion of any larger diameter coin that can be sorted during at least part of the path of movement of the smallest diameter coin under the gravitational/inertial (including centrifugal) forces thereon, said guide surface being designed to cooperate with the arcuate surface of the housing to guide the smallest diameter coin to its respective coin bin.

11. An animated sorting bank as defined in claim 10 wherein said sorting ramp is inclined to the horizontal so that a coin can roll therealong under gravitational/inertial forces, said sorting ramp having a series of sorting slots each dimensioned to receive a respective diameter coin and to direct the coin to its respective coin bin, the sorting slot for the smallest diameter coin being disposed above the slots for the remaining diameter coins, and the arcuate surface on the housing being dimensioned to guide the remaining diameter coins along an arcuate path which partially bypasses the sorting slot for the smallest diameter coin as the remaining diameter coins are directed to the sorting ramp.

12. An animated sorting bank as defined in claim 11, wherein said housing includes a back wall, a front cover spaced from said back wall and a side wall joining said front and back walls, said arcuate surface being defined by a segment of said side wall.

13. An animated sorting bank as defined in claim 12 wherein said guide surface is defined by a portion of said back wall.

14. An animated sorting bank as defined in claim 13 wherein said back wall defines an arcuate ramp partially circumscribing said central axis of said display member, said arcuate ramp being disposed to receive a coin deposited in said inlet and to guide the coin along the arcuate segment of its path of travel, said guide surface being disposed radially outward of said arcuate ramp.

15. An animated sorting bank as defined in claim 14 wherein said sorting ramp includes an inclined surface extending forwardly of said back wall for engaging an edge of a coin and a portion of said back wall exending along said inclined surface, said portion of said back wall carrying said sorting slots, said inclined surface being configured to tip a coin backward toward said back wall, so that a coin moving along said inclined surface is tipped backward toward said back wall to facilitate sorting of said coin in an appropriate sorting slot in said back wall.

16. An animated sorting bank as defined in claim 14 wherein said display member comprises a disc that overlaps portions of a plurality of sorting slots in said back wall.

17. An animated sorting bank as defined in claim 15 wherein the display member comprises a disc, and the means on the display member for engaging a coin comprises a plurality of pins protruding from a surface of said disc.

18. An animated sorting bank as defined in claim 17 wherein said composite image is produced by a moire effect between the material on a surface of the disc and the material on the display wall housing, the plurality of pins being located so that each of the coins rotates the disc at a speed that is sufficient to produce the moire effect image.

19. An animated sorting bank as defined in claim 18 wherein said sorting ramp comprises a single inclined surface, and all of said sorting slots on said back wall are disposed along said single inclined surface.

20. An animated sorting bank as defined in claim 19 wherein said back wall is disposed at an angle to the vertical.

21. An animated sorting bank comprising a housing having an inlet for receiving a coin in an upright orientation, a back wall and a front display wall; a display member supported for rotation about a central axis; and a sorting area comprising a plurality of sorting slots and a sorting ramp; said front and back walls being substantially parallel to each other and spaced apart by a distance that confines a coin to an upright orientation as it moves from said inlet to said sorting area; said back wall having said sorting slots and said sorting ramp extending into the space between said front and back walls to engage a coin moving in an upright orientation between said front and back walls; said display member being at least partly disposed between said front and back walls and being rotatable relative to said front display wall to cause animation of a composite image formed partly on said display member and partly on said front display wall; a plurality of coin bins, each dimensioned to receive a different diameter coin; said sorting ramp and sorting slots being designed to receive coins of different diameters and to sort the coins in respective coin bins according to their diameters, said housing and said display member cooperating to receive a coin from said inlet in an upright condition and to guide said coin by gravitational/inertial forces between said inlet and said sorting area while maintaining the coin in the upright orientation; the path of travel of the coin between the inlet and the sorting area including an arcuate segment that at least partly circumscribes the central axis of the display member; the display member including a plurality of circumferentially spaced actuating surfaces each of which can be engaged by a coin as the coin moves in an upright orientation along the arcuate segment of its path of travel; the actuating surfaces being disposed at least partly in the space between said front and back walls so that when a coin moves along the arcuate segment of its path of travel and engages an actuating surface a force-couple is applied to the display member to rotate the display member about its central axis; the housing and the display member being dimensioned so that a coin is released from engagement from an actuating surface on the display member after imparting rotation to the display member; and the ramp extending between said front and back walls below and in the path of a coin that is released from an actuating surface on the display member.

22. An animated sorting bank comprising a housing having an inlet for receiving a coin in an upright orientation, a back wall, and a front display wall spaced from said back wall; a display member in the form of a disc extending at least partially between said back wall and display wall and supported for rotation about a central axis; and a sorting area comprising a plurality of coin bins and a sorting ramp; said display member being rotatable relative to a display wall of said housing to cause animation of a composite image formed partly on said display member and partly on said display wall of said housing, each of said coin bins being dimensioned to receive a different diameter coin, said sorting ramp being designed to receive coins of different diameters and to sort the coins in respective coin bins according to their diameters, said sorting ramp having a series of sorting slots in said back wall each dimensioned to receive a respective diameter coin and to direct the coin to its respective coin bin, said display member overlapping portions of a plurality of the sorting slots in said back wall, said housing and said display member cooperating to receive a coin from said inlet in an upright condition and to guide said coin by gravitational/inertial forces between said inlet and said sorting area while maintaining the coin in the upright orientation, the path of travel of the coin between the inlet and the sorting area including an arcuate segment that at least partly circumscribes the central axis of the display member, the display member including a plurality of circumferentially spaced actuating surfaces each of which can be engaged by a coin as the coin moves in an upright orientation along the arcuate segment of its path of travel, the actuating surfaces being disposed so that when a coin moves along the arcuate segment of its path of travel and engages an actuating surface a force-couple is applied to the display member to rotate the display member about its central axis, the housing and the display member being dimensioned so that a coin is released from engagement from an actuating surface on the display member after imparting rotation to the display member, the housing allowing a coin that is released from an actuating surface on the display member to move toward said sorting ramp under gravitational/inertial forces.

23. A toy bank comprising a housing having an inlet for receiving coins of different diameters, a display means comprising a front display wall, a display member supported for movement behind said front display wall, and coin receptacle means for receiving coins of different diameters; said display member being movable within a predetermined range of movement relative to said front display wall in a plane parallel to said front display wall to cause an optical illusion in a composite image formed partly on said display member and partly on said front display wall in superimposition; said coin receptacle means being disposed beneath said inlet and said housing being configured such that coins of different diameters are guided through said housing and to said coin receptacle means by gravitational/inertial forces; actuating means engageable by coins of different diameters passing from said inlet to said coin receptacle means by gravitational/inertial forces; and means responsive to engagement of a coin with the actuating means for effecting movement of said display member within said predetermined range to cause said optical illusion in said composite image.

24. A bank as set forth in claim 23, wherein said display member comprises a disc mounted in said housing for rotation relative to said front display wall.

25. A bank as set forth in claim 24, wherein said housing includes a back wall disposed in a plane parallel to said front display wall, and said disc extends at least partly between said front and back walls.

26. A bank as set forth in claim 23, wherein said composite image imparts a moire effect upon movement of said display member.

* * * * *